United States Patent [19]

Omata et al.

[11] Patent Number: 5,014,588

[45] Date of Patent: May 14, 1991

[54] ELECTRONIC STRINGED MUSICAL INSTRUMENT WITH A STRING VIBRATION DETECTING APPARATUS

[75] Inventors: Fumio Omata, Chofu; Katutosi Sakai, Akigawa; Yoshio Nomura, Oome, all of Japan

[73] Assignee: Casio Computer Co., Ltd., Tokyo, Japan

[21] Appl. No.: 359,687

[22] Filed: May 31, 1989

[30] Foreign Application Priority Data

Jun. 3, 1988 [JP] Japan ..... 63-74044[U]

[51] Int. Cl.[5] ..... G10H 3/18

[52] U.S. Cl. ..... 84/726; 84/743

[58] Field of Search ..... 84/723, 724, 725, 726, 84/727, 728, 730, 731, 733, 734, 742, 743

[56] References Cited

U.S. PATENT DOCUMENTS

| | | | |
|---|---|---|---|
| 3,015,247 | 1/1962 | Allers | 84/273 |
| 3,733,953 | 5/1973 | Ferber | 84/724 |
| 4,160,401 | 7/1979 | Tomioka | 84/731 |
| 4,201,108 | 5/1980 | Bunker | 84/723 |
| 4,236,433 | 12/1980 | Holland | 84/726 |
| 4,501,186 | 2/1985 | Ikuma | 84/726 |
| 4,658,690 | 4/1987 | Aitken et al. | 84/1.14 |
| 4,702,141 | 10/1987 | Bonanno | 84/1.16 |
| 4,723,468 | 2/1988 | Takabayashi et al. | 84/DIG. 30 X |
| 4,765,219 | 8/1988 | Alm | 84/1.15 |
| 4,911,053 | 3/1990 | Kashio et al. | 84/727 X |
| 4,928,563 | 5/1990 | Murata et al. | 84/726 |

FOREIGN PATENT DOCUMENTS

| | | | |
|---|---|---|---|
| 63-51395 | 4/1988 | Japan . | |
| 2045993 | 11/1980 | United Kingdom | 84/726 |
| 2221558 | 2/1990 | United Kingdom | 84/727 X |
| 87/04288 | 7/1987 | World Int. Prop. O. | 84/726 |

*Primary Examiner*—W. B. Perkey

*Attorney, Agent, or Firm*—Frishauf, Holtz, Goodman & Woodward

[57] ABSTRACT

The present invention relates to an electronic stringed musical instrument with a string vibration detecting device, such as an electronic guitar, guitar synthesizer, electronic violin, etc. A string supporting unit for supporting and fixing at least one end of stretched strings is removably mounted on a body unit. A string vibration detecting device and an electronic processing substrate, such as a printed board, are removably mounted on the string supporting unit.

9 Claims, 4 Drawing Sheets

ELECTRONIC STRINGED MUSICAL INSTRUMENT WITH A STRING VIBRATION DETECTING APPARATUS

BACKGROUND OF THE INVENTION

1. Field of the Invention

The present invention relates to an electronic stringed musical instrument in which a string vibration detector, called a pickup device, detects vibrations of strings and produces electrical signals corresponding to the detected vibrations, and musical sounds to be produced by musical sound generating means are controlled in response to the produced electrical signals, and more particularly, to a technology for mounting a string supporting unit, used to support one end of each of stretched strings, on a body unit.

2. Description of the Related Art

The following are descriptions of conventional electronic stringed musical instruments of this type, and U.S. related applications.

Disclosed in pending U.S. patent application Nos. 112,780; 184,099; 256,398; and 252,914 (assigned to the assignee of this application) are guitar synthesizers or electronic guitars, which use an electromagnetic type pickup device, a pitch extracting device, and a pitch designating device. The pickup device magnetically detects vibration of each string and produces a pickup signal in response to the detected string vibration. The pitch extracting device extracts a string vibration cycle (i.e., string vibration pitch) from the pickup signal. The pitch designating device is used to designate a pitch corresponding to the extracted string vibration pitch. On account of the use of the pitch extracting device, the guitar synthesizers or electronic guitars of this type are called electronic stringed musical instruments of a pitch-extraction type.

Disclosed in Japanese Utility Model Disclosure No. 63-51395 (assigned to the assignee of this application) is an electronic stringed musical instrument which uses an electromagnetic type pickup device, an envelope detecting device, and a peak measuring device. The pickup device magnetically detects vibration of each string and produces a pickup signal in response to the detected string vibration. The peak detecting device detects an envelope signal from the pickup signal. The peak measuring device is used to measure the peak of each envelope signal. The peak of each envelope signal indicates the strength of a string touch, and the envelope signal is used to control the volume of a musical sound to be produced by musical sound generating means.

Since the control of the production of the musical sounds is triggered by the vibrations of the strings, the aforesaid musical instrument is called an electronic stringed musical instrument of a string-triggered type.

Disclosed in U.S. Pat. No. 4,723,468, moreover, is an electronic stringed musical instrument which uses an electromagnetic type pickup device and a fingering position detecting device. The pickup device magnetically detects vibration of each string. The position detecting device detects a fingering position for each string on a fingerboard by using an ultrasonic waves. A pickup signal produced by the pickup device indicates a state of vibration of each string, and is used to instruct the start and end of production of musical sounds by musical sound generating means, and to control the volume of the produced musical sounds. The instrument of this type is called an electronic stringed musical instrument of an ultrasonic type, on account of the use of ultrasonic waves.

Disclosed in U.S. Pat. No. 4,765,219, furthermore, is an electronic stringed musical instrument of a violin type which uses a pickup device for electromagnetically detecting vibrations of strings and producing pickup signals in response to the detected string vibrations.

Disclosed in U.S. Pat. No. 4,702,141, moreover, is an electronic stringed musical instrument of an optical-pickup type which uses a pickup device for optically detecting string vibrations and producing pickup signals in response to the detected string vibrations.

Disclosed in U.S. Pat. No. 4,658,690, furthermore, is an electronic stringed musical instrument of a Hall-device type which uses a pickup device for detecting string vibrations by means of a combination of a Hall-device and a magnet and producing pickup signals in response to the detected string vibrations.

In order to produce specific musical sounds in response to vibrations of picked strings, in any of the electronic stringed musical instruments of various these types, it is essential to provide a pickup device for detecting the string vibrations produced by a plucking operation as electrical signals and an electric circuit for electrical processing to produce the musical sounds. In the case of a so-called electric guitar or an electronic stringed musical instrument of an electric-guitar type, for example, the electrical signals are directly amplified or processed as required, to be used as a sound source for the production of the specific musical sounds. In the cases of the electronic stringed musical instruments of the aforementioned pitch-extraction type, string-triggered type, or ultrasonic type, the electrical signals are used to control the tone or volume of musical sounds produced by separate musical sound generating means.

In the conventional electronic stringed musical instruments, the pickup device and a circuit substrate constituting the specific electric circuit are arranged around a string supporting member for supporting one end of each string. In this case, the pickup device and the substrate are mounted independently of the supporting member, on the body of the stringed musical instrument. According to this conventional arrangement, therefore, the string supporting member, the pickup device, and the circuit substrate are mounted on the instrument body naturally in separate processes. Thus, the assembly work for the instrument body is troublesome. In this arrangement, moreover, if the pickup device or the circuit substrate, for example, must be replaced due to some trouble, it occasionally is impossible to remove only the damaged element from the instrument body. In most cases, therefore, some other parts on the instrument body must be also removed therefrom for the replacement.

In the case of the stringed musical instrument of the string-triggered type, when a pickup signal is delivered from the pickup device, as mentioned before, a musical sound of any desired tone, selected among various tones preset in the musical sound generating means, is produced in response to the attainment of a predetermined level by the pickup signal. If a string vibration continues over a predetermined period of time after the production of the specific musical sound, the level of the pickup signal following the string vibration exceeds the predetermined level over the predetermined period of time. Thus, an unexpected sound may sometimes be produced against a player's intention. In order to prevent this, the string vibration must be suppressed in a short period of time directly after the string is plucked.

Disclosed in U.S. Pat. No. 3,015,247 is a stringed musical instrument which is provided with a string vibration damping member for damping string vibration in a short period of time after string plucking operation. In this instrument, however, a string supporting unit for supporting strings is formed independently of the damping member. When the supporting unit is fixed to the body of the stringed musical instrument, therefore, the vibration damping member sometimes cannot be properly pressed against the string. In such a case, the damping member cannot fulfill its string vibration damping function.

SUMMARY OF THE INVENTION

The present invention has been contrived in consideration of these circumstances, and has an object to provide an electronic stringed musical instrument, in which a pickup device and the like can be readily assembled and mounted on the body of the instrument, and the pickup device and an electric circuit substrate can be easily replaced in case of trouble.

Another object of the invention is to provide an electronic stringed musical instrument capable of securely effectively suppressing string vibration in a short period of time directly after string plucking operation.

In order to achieve the former object, an electronic stringed musical instrument according to the present invention is characterized by comprising a body unit, at least one string stretched over the body unit, a string supporting unit removably mounted on the body unit to support and fix at least one end of the string, string vibration detecting means removably mounted on the string supporting unit to detect vibration of the string and deliver an electrical signal corresponding to the detected vibration, and an electronic processing substrate removably mounted on the string supporting unit and adapted to perform electric processing for controlling a musical sound to be produced, in response to the electrical signal detected by the string vibration detecting means.

In order to achieve the latter object, the electronic stringed musical instrument according to the present invention is further characterized by comprising a string vibration damping member located near the string vibration detecting means to damp the vibration of the string.

DETAILED DESCRIPTION OF THE PREFERRED EMBODIMENTS

An embodiment of the present invention will now be described with reference to the accompanying drawings.

Figure 1:
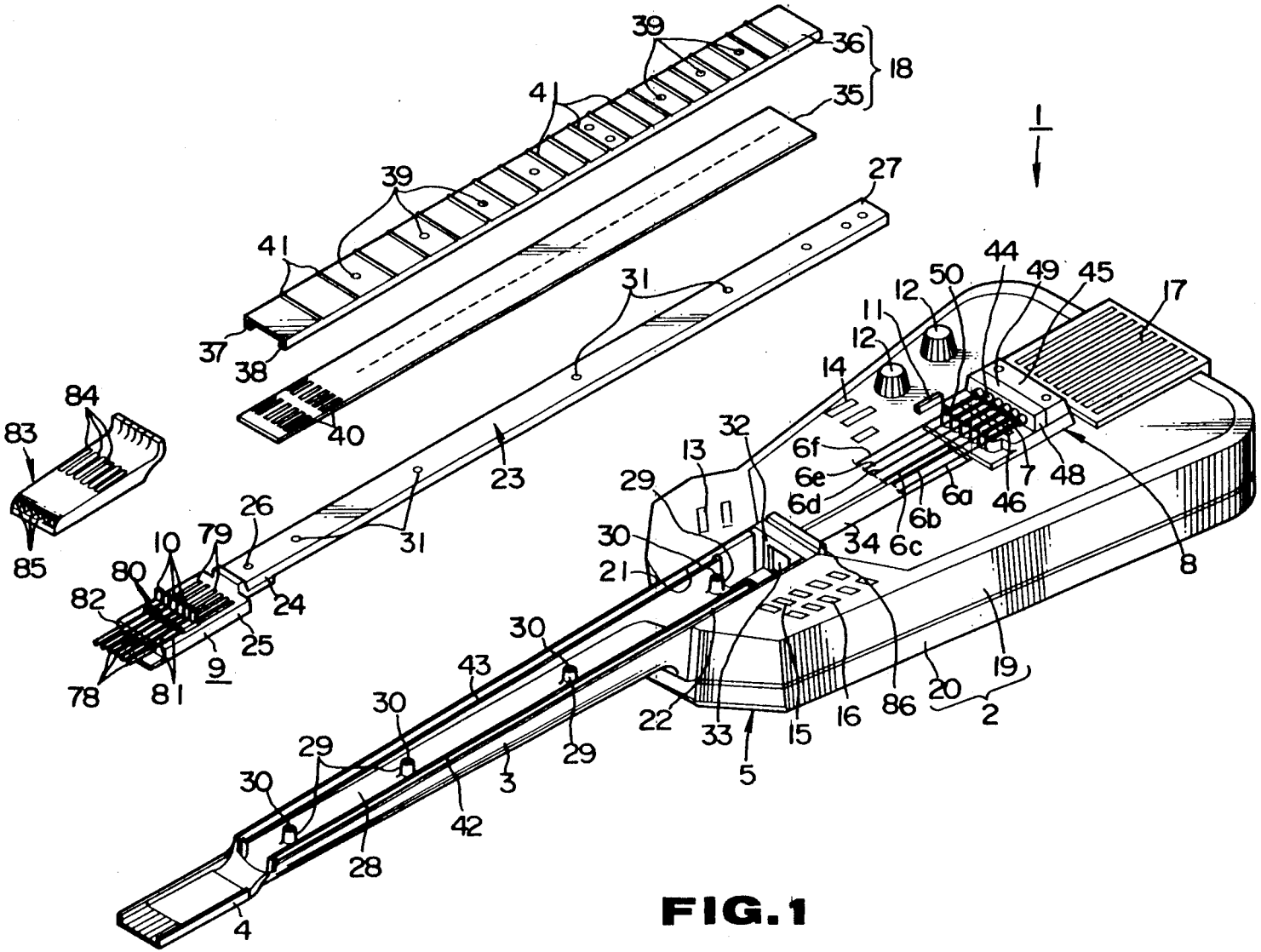
FIG. 1 is a schematic exploded perspective view of an electronic stringed musical instrument according to the present invention.
Figure 2:
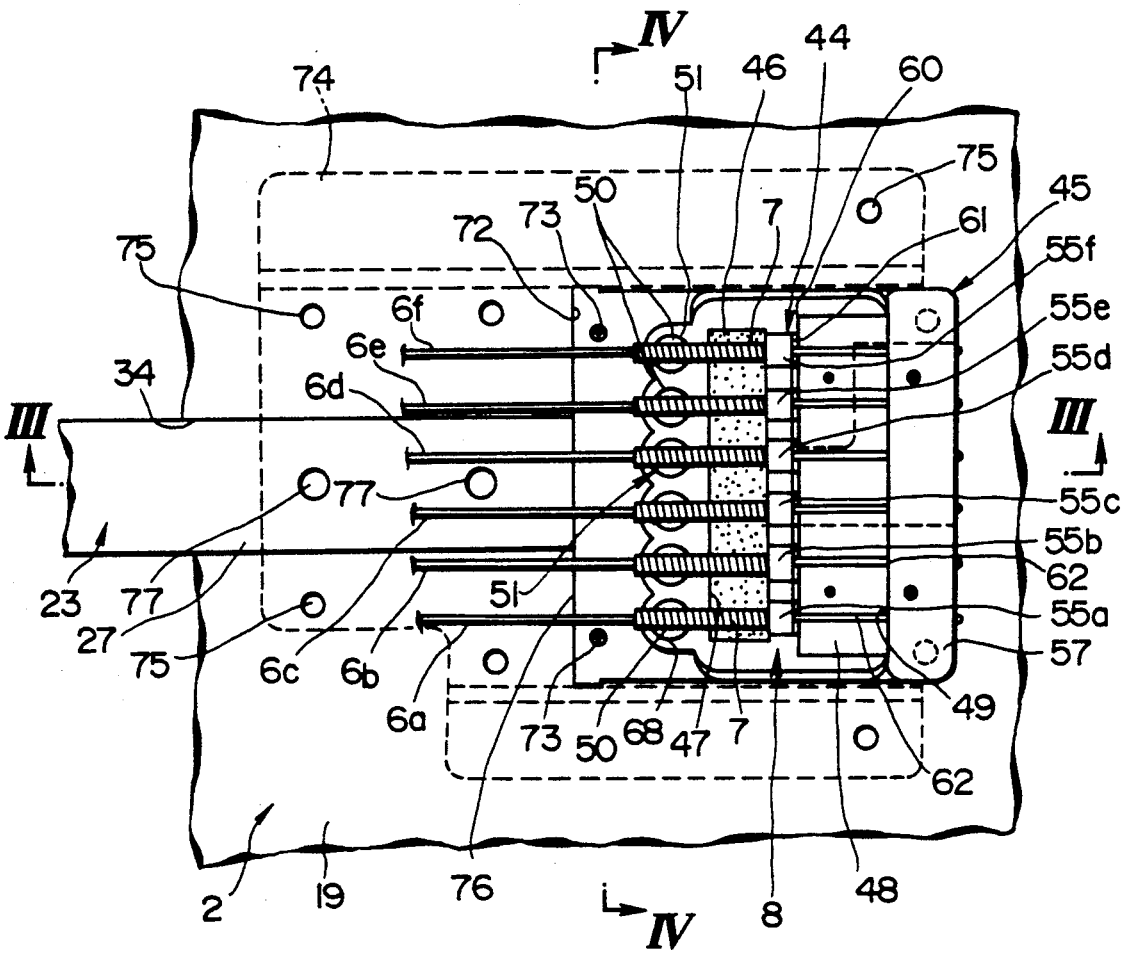
FIG. 2 is a schematic plan view of a string supporting unit mounted on the top surface of a body of the electronic stringed musical instrument.

FIG. 1 is an exploded perspective view schematically showing an electronic stringed musical instrument according to an embodiment of this invention.

Electronic stringed musical instrument 1 shown in FIG. 1 is in the form of a guitar. On body unit 5, which is composed of body 2, neck 3, and head 4, six strings *6a* to *6f* (partially shown in FIG. 1) are stretched parallel to one another between body 2 and head 4, in the longitudinal direction of neck 3. Each string is a nonmagnetic string (nylon, silk-thread, or gut) on which magnetic coil spring 7 is fitted at a position near the body-side end portion thereof (see FIG. 3). The prospective body-side end portions of strings *6a* to *6f* are supported by string supporting portion 44 of string supporting unit 8 (which will be described later with reference to FIGS. 2 to 5), and are fixed by means of string fixing portion 45. Supporting unit 8 is removably mounted on the center of the rear portion of the top surface of body 2. The respective head-side end portions of strings *6a* to *6f* are fixed individually to tuning pegs 10 of string tension adjusting mechanism 9 (which will be described later) fixed to the top surface of head 4.

Arranged on the top surface of body 2 of body unit 5 are power switch 11, volume controls 12, mute switches 13, pat control switches 14, rhythm select switches 15, tone select switches 16, etc., as well as string supporting unit 8. A circuit substrate (not shown), on which an electric circuit for electronic stringed musical instrument 1, and speaker 17 are formed, are arranged inside body 2. Fingerboard 18 (mentioned later) is mounted on the upper surface of neck 3.

Body 2 are constructed by coupling upper and lower halves 19 and 20, which are made of synthetic resin and are formed independently of each other, by means of bolts (not shown). Neck 3 is also made of synthetic resin and is formed independently of body 2. Neck 3 is coupled integrally to body 2 by means of bolts (not shown) or the like, after proximal end portion 22 of neck 3 is fitted into groove 21 formed in the center of the front portion of the upper surface of body 2.

Belt-shaped metallic reinforcing member 23 extends along the upper surface of neck 3 and the inner surface of upper half 19 of body 2 from head 4 formed integrally on the free end of neck 3 to a portion of the top surface of body 2 on which string supporting unit 8 is mounted. Head-side end portion 24 of reinforcing member 23 is coupled integrally, by means of bolt 26, to metallic base member 25 of string tension adjusting mechanism 9, which is fixed to the top surface of head 4. Body-side end portion 27 of member 23 is connected to supporting unit 8 by means of bolts 77 (see FIGS. 2 to 4). Metallic reinforcing member 23 is housed in the entrance of opening 28 in the upper surface of neck 3. A plurality of bosses 29 are formed integrally on the bottom surface of opening 28 so as to be arranged at predetermined intervals in the longitudinal direction, and member 23 is fixed to neck 3 by means of bolts (not shown) which are inserted in bolt holes 31 of member 23 and are screwed in tapped holes 30 in the upper end faces of bosses 29. Body-side end portion 27 of member 23 is inserted in shallow belt-shaped groove 34 formed in the center of the top surface of body 2, through hole 33 bored in body-side end plate 32 of neck 3. In this arrangement, the upper surface of reinforcing member 23 is flush with the top surface of body 2.

Fingerboard 18 is composed of elastic flexible rubber sheet 36 and circuit substrate 35 which is attached integrally to the lower surface of sheet 36. Substrate retaining projections are formed individually along the both longitudinal edges of the lower surface of sheet 36. These projections have their respective grooves 37 and 38 whose cross section is substantially C-shaped. Circuit substrate 35 are integrated on flexible sheet 36 by fitting the both longitudinal edges of substrate 35 in grooves 37 and 38 of sheet 36. Also, substrate 35 and sheet 36 are coupled to each other by means of bolts (not shown) inserted in bolt holes 39 of sheet 36. Fixed contacts 40 are provided on the upper surface of circuit substrate 35. Fixed contact 40 are arranged on the upper surface under the strings at each halftone of each string. Frets 41 are arranged on the upper surface of flexible sheet 36 at positions corresponding to the individual halftones of strings 6*a* to 6*f*. Movable contacts (not shown) are provided on the lower surface of sheet 36. Movable contacts are arranged on the lower surface at positions corresponding to fixed contacts 40. Spacers (not shown) are interposed between the adjacent movable contacts on the lower surface of sheet so as to form vertical gaps between the movable contacts and fixed contacts 40 on substrate 35. If the upper surface of elastic flexible sheet 36 is depressed, the movable contact which corresponds to the depressed portion of the upper surface contacts its corresponding fixed contact 40. As a result, a fret switch which corresponds to the depressed portion is turned on, so that a predetermined pitch designating signal is delivered to a musical sound generator circuit (contained in body 2) as a sound source and the pitch of a musical sound produced by the sound generator circuit is set. Fixed contacts 40 and the movable contacts are formed on the upper surface of circuit substrate 35 and the lower surface of flexible sheet 36, respectively, by carbon printing. Frets 41 and the aforesaid spacers (not shown) are formed integrally on the upper and lower surfaces of the flexible sheet 36, respectively. Fingerboard 18 constructed in this manner is placed on support ribs 42 and 43 formed integrally on the both longitudinal edges of opening 28 in the upper surface of neck 3 so as to be fitted in opening 28 in a state that it is superposed on the upper surface of metallic reinforcing member 23. Fingerboard 18 is fixed to neck 3 by means of bonding agent.

String supporting unit 8 is formed of synthetic resin, and is provided on its upper surface with string supporting portion 44, string fixing portion 45, mounting portion 47 for string vibration damping member (damper) 46, mounting portion 49 for spring fixing member 48 which is used to fix coil springs 7 fitted on strings 6*a* to 6*f*, and mounting portion 51 for electromagnetic type pickups 50 as pickup means, as shown in FIGS. 2 to 5. Mounting portion 53 for circuit substrate 52 is formed on the lower surface of unit 8.

String supporting portion 44 is formed substantially in the center of the upper surface of string supporting unit 8, with respect to the longitudinal direction of strings 6*a* to 6*f*. Portion 44 is composed of a plurality of string supporting projections 55*a* to 55*f* which protrude substantially vertically at positions corresponding to strings 6*a* to 6*f*. Each projection has horizontal string hole 54 through which its corresponding string is passed. Hole 54 has a diameter large enough to allow the passage of coil spring 7, and spring 7 fitted on its corresponding string is passed through each corresponding hole 54.

Figure 3:
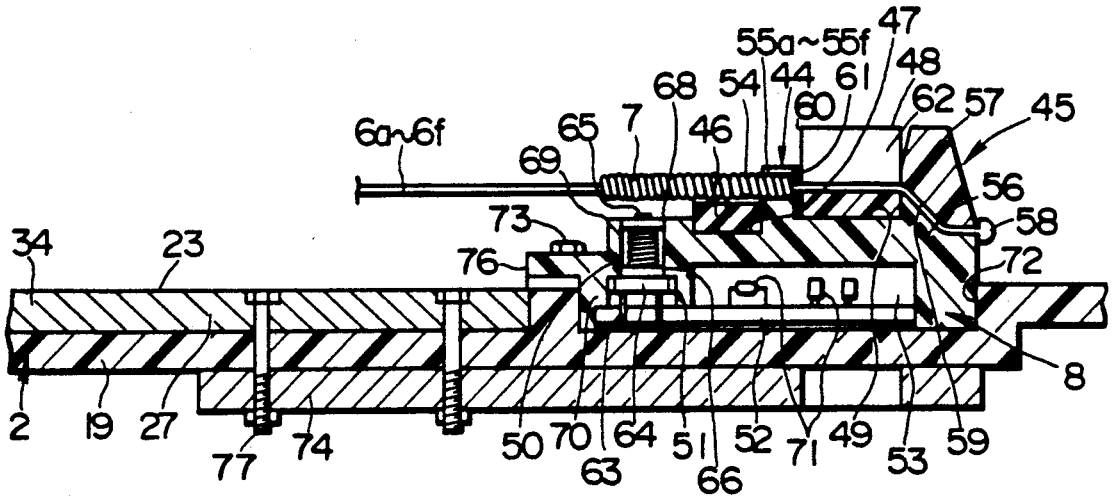
FIG. 3 is a schematic sectional view taken along line III—III in FIG. 2.
Figure 4:
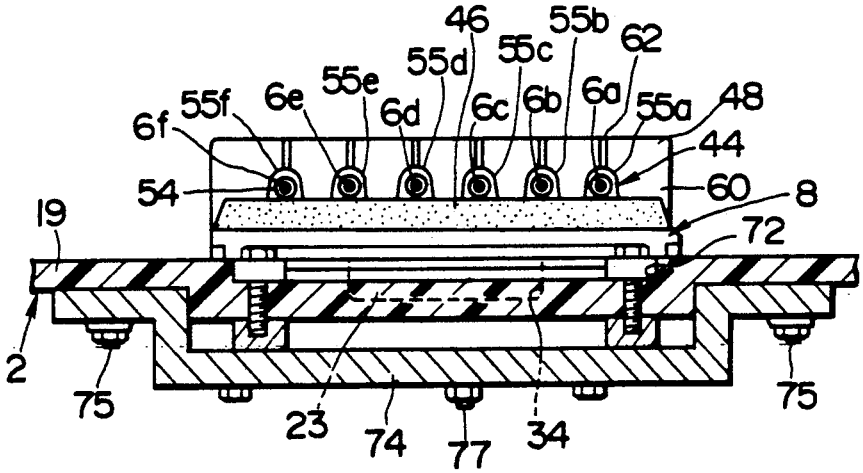
FIG. 4 is a schematic sectional view taken along line IV—IV in FIG. 2.
Figure 5:
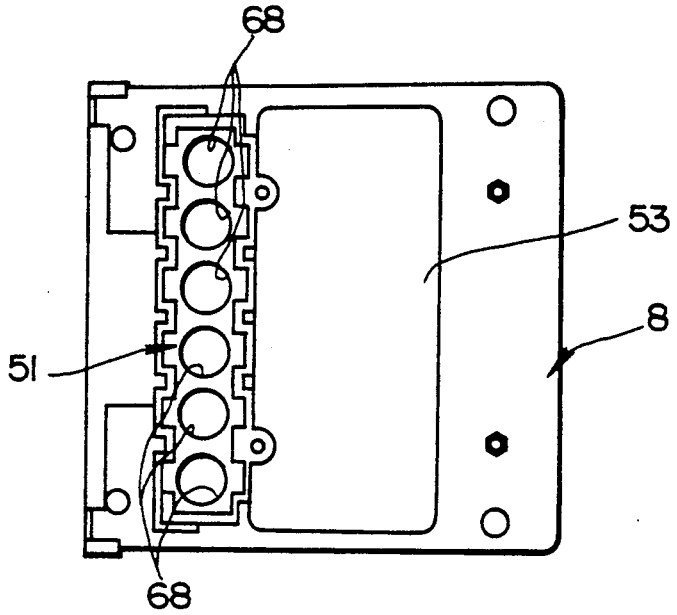
FIG. 5 is a schematic bottom view of the string supporting unit.

String fixing portion 45 is situated on the rear end portion of the upper surface of string supporting unit 8, and is composed of lower half 56 formed integrally on the upper surface of unit 8 and upper half 57 removably connected to lower half 56 by means of bolts (not shown). The upper surface of lower half 56 is serrated so that its cross section has vallies as many as strings 6*a* to 6*f*. The bottom end of each valley is in the form of semicircular groove 58 in which each corresponding string can be fitted without being damaged. The lower surface of upper half 57, which contacts the upper surface to lower half 56, is also serrated so that its cross section has vallies as many as strings 6*a* to 6*f*. As in the case of the upper surface of lower half 56, the bottom end of each valley is in the form of semicircular groove 59 in which each corresponding string can be fitted without being damaged. In string fixing portion 45 constructed in this manner, the body-side end portions of strings 6*a* to 6*f* are fitted into their corresponding grooves 58 of lower half 56 after upper half 57 is removed from lower half 56. Then, the two halves 56 and 57 coupled together by means of bolts so that the respective body-side end portions of the strings are fixed on string supporting unit 8, as shown in FIG. 3.

String vibration damping member 46 is used to damp the vibration of plucked strings in a short period of time (several seconds). It is in the form of a square pillar made of silicone rubber or hard synthetic rubber. Mounting portion 47 for damping member 46 is arranged in front of string supporting portion 44 on the upper surface of string supporting unit 8. Portion 47 is composed of a groove formed in the upper surface of unit 8 so that damping member 46 can be press-fitted therein.

Spring fixing member 48 is used to fix coil springs 7 fitted on strings 6*a* to 6*f* and supported by string supporting portion 44. Member 48 is formed of synthetic resin to have a square pillar shape, and is fitted in groove-shaped mounting portion 49 defined between supporting portion 44 and fixing portion 45 on the upper surface of string supporting unit 8. Coil springs 7 are pressed at large-diameter portions 61 of the body-side ends thereof on to the rear end surface of string supporting portion 44 by supporting portion-side end face 60 of spring fixing member 48 titled in mounting portion 49, so that coil spring 7 are fixed on their corresponding strings with respect to the longitudinal direction thereof.

Before the strings are passed through their corresponding coil springs 7, the springs are passed individually through string holes 54 of string supporting portion 44 from the rear end side thereof. Thereafter, spring fixing member 48 is fitted into mounting portion 49. Formed in the upper surface of string fixing member 48 are deep grooves 62 which are cut to the depth of the center holes at positions corresponding to the center holes of springs 7. Strings 6*a* to 6*f* are inserted into their corresponding springs 7 from the side of string fixing portion 45 toward head 4. As the strings are fitted in their corresponding deep grooves 62 of fixing member 48 between springs 7 and fixing portion 45, member 48 is fixedly pressed against groove-shaped mounting portion 49 by the strings.

Figure 6:
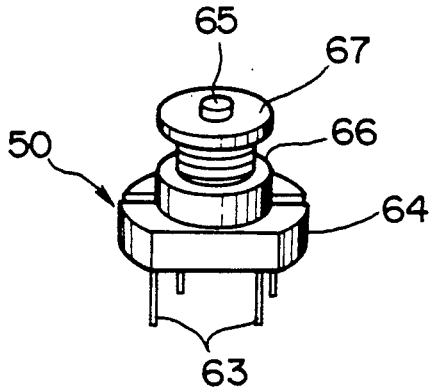
FIG. 6 is a schematic perspective view of an electromagnetic type pickup attached to the string supporting unit.

As shown in FIG. 6, each electromagnetic type pickup 50 includes holder 64 having a plurality of output terminals 63, core 65 mounted on the upper surface of holder 64, and coil bobbin 67 fitted on core 65 and wound with coil 66. When coil springs 7 fitted on strings 6*a* to 6*f* change magnetic flux produced in electromagnets (each including core 65, coil 66, and bobbin 67) of their corresponding electromagnetic type pickups 50 by string vibration attributable to plucking operation, induced electric potential is produced. The induced electric potential is detected as an electrical signal responsive to the string vibration. Mounting portion 51 for pickups 50 is composed of a plurality of stepped through holes 68 which are arranged in front of mounting portion 47 for string vibration damping member 46 on the upper surface of string supporting unit 8, so as to correspond to strings 6*a* to 6*f*. Pickups 50 are fitted into their corresponding through holes 68 from the lower openings thereof. In this case, each electromagnet (including elements 65, 66 and 67) is fitted into small-diameter portion 69 of its corresponding hole 68 on the upper side thereof, while each holder 64 is fitted into large-diameter portion 70 on the lower side. Since electromagnetic type pickups 50 are mounted on circuit substrate 52 (described in detail later), they are automatically set in their corresponding through holes 68 when substrate 52 is fixed to mounting portion 53 on the lower surface of string supporting unit 8.

Mounted on circuit substrate 52 are specific electronic parts 71, circuits connected to electromagnetic type pickups 50, etc. Parts 71 serve to process electrical signals detected by pickups 50 and deliver the processed signals to the musical sound generator circuit as the sound source (contained in body 2). Substrate 52 is fitted in hollow mounting portion 53 on the lower surface of string supporting unit 8, and is fixed to the lower surface by means of bolts (not shown).

String supporting unit 8 constructed in this manner is fitted in hollow 72 in the top surface of body 2, and is removably mounted on body 2 by means of a plurality of bolts 73. A supporting unit mounting region of the top surface of body 2, in which hollow 72 is formed, is reinforced by means of metal plate 74, which is fixed to the inner surface of the upper wall of upper half 19 of body 2 by means of bolts so as to correspond to the mounting region. As shown in FIG. 3, the front end portion of plate 74 and body-side end portion 27 of metallic reinforcing member 23, which projects from the neck side into groove 34 in the top surface of body 2, face each other with the upper wall of body 2 or upper half 19 being interposed their between. These two end portions are fixed to each other by means of a plurality of bolts 77 penetrating the upper wall of body 2.

A sensor cover (not shown) is removably mounted on string supporting unit 8 so as to protect electromagnetic type pickups 50 and the like, which are exposed on the upper surface of unit 8. String vibration damping member (damper) 86 is mounted on the upper surface of body-side end plate 32 at proximal end portion 22 of neck 3 so as to project upward from the top surface of body 2.

String tension adjusting mechanism 9 on head 4 includes base member 25, a plurality of pegs 10 arranged on member 25 so as to correspond to strings 6*a* to 6*f* and be slidable in the longitudinal direction of the strings, and operating members 78 attached to pegs 10 and used to slide the pegs. A plurality of guide grooves (dovetail grooves) 79 are formed on the upper surface of base member 25 so as to correspond to strings 6*a* to 6*f* and extend in the longitudinal direction of the strings. Nut 80, which is formed integrally on the lower portion of its corresponding peg 10, is slidably fitted in each guide groove 79. Screw rod (male screw) 81 of a predetermined length is fixed to each nut 80. Rod 81 extends in each corresponding guide groove 79 toward free end face 82 of base member 25 in the longitudinal direction of each string. Cylindrical operating member (bar nut) 78 is threadedly engaged with the free end portion of each screw rod 81 which projects from groove 79. Operating member 78 has an internal thread at one end to mate with rod 81, and a hexagonal hole at the other end to be adapted to engage a tool (hex wrench) for rotating the operating member 78.

Since one end of each operating member 78 abuts against free end face 82 of base member 25, if member 78 is turned by means of the hex wrench, each peg 10, along with its corresponding screw rod 81, slides in guide groove 79 in the longitudinal direction of the string. As pegs 10 are thus slid relatively to base member 25, strings 6*a* to 6*f*, whose head-side end portions are fixed to pegs 10, are adjusted in tension. This tension adjustment can be achieved without removing cover 83 from string tension adjusting mechanism 9. Cover 83, which is removably mounted on head 4, has guide grooves 84 on its upper surface. Pegs 10 are inserted in grooves 84 for sliding motion. Holes 85 for operating members 78 are bored through the front end face of cover 83.

In electronic stringed musical instrument 1 of the present embodiment constructed in this manner, electromagnetic type pickups 50 and circuit substrate 52 are attached to string supporting unit 8 which is removably mounted on body 2. Therefore, pickups 50 and substrate 52 can be set in a predetermined position in instrument 1 by previously attaching them to specific mounting portions 51 and 53 in supporting unit 8, and then mounting unit 8 on a predetermined portion of the top face of body 2 by means of bolts 73.

If electromagnetic type pickups 50 and circuit substrate 52 are out of order, they can be easily replaced by removing only string supporting unit 8, among other elements on body 2, from the body.

In the embodiment described above, the present invention is applied to an electronic stringed musical instrument of a string-triggered type. The invention is not limited to this embodiment, however, and may be also applied to electronic stringed musical instruments of a pitch-extraction type, ultrasonic, etc.

What is claimed is:

1. An electronic stringed musical instrument comprising:

a body unit;

at least one string stretched over said body unit;

a string supporting unit removably mounted on said body unit to support and fix at least one end of said at least one string;

string vibration detecting means, removably mounted on said string supporting unit, for detecting vibration of said at least one string and for generating an electrical signal corresponding to the detected vibration;

an electronic processing substrate removably mounted on a lower portion of said string supporting unit, and including an output terminal supporting portion which supports a plurality of output terminals for outputting the electrical signal generated by said string vibration detecting means; and a cylindrical magnetic member having one end which is removably attached to said string supporting unit, and having another end which is fitted on said at least one string, and said cylindrical magnetic member having a center hole in which said at least one string is passed, said cylindrical magnetic member being flexible so as to follow a movement of said at least one string passed therein.

2. The electronic stringed musical instrument according to claim 1, further comprising a string vibration damping member located near said string vibration detecting means to damp the vibration of said at least one string.

3. The electronic stringed musical instrument according to claim 2, wherein said string vibration damping member is removably mounted on said string supporting unit.

4. The electronic stringed musical instrument according to claim 1, further comprising musical sound generating means, mounted in said body unit, for generating a corresponding musical sound based on said electrical signal generated by said string vibration detecting means.

5. The electronic stringed musical instrument according to claim 1, wherein said at least one string is formed of a nonmagnetic material.

6. The electronic stringed musical instrument according to claim 1, wherein said cylindrical magnetic member is comprises a coiled magnetic wire material.

7. The electronic stringed musical instrument according to claim 1, wherein said at least one string is formed of a magnetic material, and said string vibration detecting means comprises an electromagnetic type pickup device.

8. The electronic stringed musical instrument according to claim 1, wherein said string supporting unit includes:

a body removably mounted on said body unit, a string supporting portion formed on said body so as to support one end of said at least one string, and a string fixing portion adapted, in conjunction with said string supporting portion, to fix said one end of said at least one string.

9. The electronic stringed musical instrument according to claim 1, wherein said string supporting unit includes a substrate mounting portion formed on the body-unit-side surface thereof, said electronic processing substrate being mounted on said substrate mounting portion.

* * * * *